US006692308B2

(12) United States Patent
Henrici et al.

(10) Patent No.: US 6,692,308 B2
(45) Date of Patent: Feb. 17, 2004

(54) HOLDER FOR HALOGEN LAMP

(75) Inventors: Dieter Henrici, Arnsberg (DE); Herbert Beleke, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 10/291,222

(22) Filed: Nov. 8, 2002

(65) Prior Publication Data

US 2003/0119376 A1 Jun. 26, 2003

(30) Foreign Application Priority Data

Dec. 21, 2001 (DE) ..... 101 63 056

(51) Int. Cl.[7] ..... H01R 24/00
(52) U.S. Cl. ..... 439/699.2; 439/356
(58) Field of Search ..... 439/699.2, 619, 439/686, 201, 356

(56) References Cited

U.S. PATENT DOCUMENTS 5,800,183 A * 9/1998 Paul et al. ..... 439/699.2
5,971,814 A * 10/1999 Boyd et al. ..... 439/356
6,039,579 A * 3/2000 Paul et al. ..... 439/699.2
6,296,529 B2 * 10/2001 Tanigawa ..... 439/699.2

FOREIGN PATENT DOCUMENTS

| | | |
|---|---|---|
| DE | 9012681 | 3/1991 |
| DE | 4418501 | 11/1995 |
| DE | 19904168 | 8/2000 |

* cited by examiner

*Primary Examiner*—Gary Paumen
(74) *Attorney, Agent, or Firm*—Herbert Dubno; Andrew Wilford

(57) ABSTRACT

A lampholder has a socket having an inner end, formed with seats adapted to hold contacts, and forming an outwardly open hole defining an axis and adapted to fit with a base of a high-voltage lamp and a base fittable against the inner end and having a floor formed with an axially throughgoing hole. A clip is formed with a bight engaged in the hole, a pair of arms extending from respective ends of the bight axially outward into the socket, outer tabs on the arms bearing axially inward on the socket, and inner tabs at the bight bearing axially outward on the floor of the base so that the clip holds the socket and base together.

8 Claims, 3 Drawing Sheets

HOLDER FOR HALOGEN LAMP

FIELD OF THE INVENTION

The present invention relates to holder for a high-voltage lamp. More particularly this invention concerns halogen lampholder.

BACKGROUND OF THE INVENTION

A standard lampholder, for instance for a high-voltage metal-halide lamp, has a ceramic or porcelain socket having an inner end and forming an outwardly open hole defining an axis and adapted to fit with a base of a high-voltage lamp, a base fittable against the inner end, and a U-shaped clip holding the socket to the base.

With halogen lamps with a standard G12 base use a socket normally about 36 mm in diameter. Contacts seated in the base fit with pins on the lamp and are connected to lead wires or have terminal screws so standard line current or more can be fed to the lamp fitted in the hole in the socket part. The base is a ceramic disk. The clip is U-shaped and has a bight that engages over the disk and a pair of arms that engage up in the socket, with tabs on the arm bearing on the socket to prevent inward movement. The lamp itself is gripped between the outer ends of the arms so that it does not fall out of the socket.

It is normally considered necessary that the parts be made of ceramic or porcelain to withstand the considerable heat of, for instance, a high-voltage halogen lamp. These materials are hard to form accurately, so that it is difficult to make the described lampholder to the tolerances necessary for easy mass manufacture.

SUMMARY OF THE INVENTION

A lampholder has according to the invention a socket having an inner end, formed with seats adapted to hold contacts, and forming an outwardly open hole defining an axis and adapted to fit with a base of a high-voltage lamp and a base fittable against the inner end and having a floor formed with an axially throughgoing hole. A clip is formed with a bight engaged in the hole, a pair of arms extending from respective ends of the bight axially outward into the socket, outer tabs on the arms bearing axially inward on the socket, and inner tabs at the bight bearing axially outward on the floor of the base so that the clip holds the socket and base together.

Thus it is possible to premount the contacts in the base and then simply clip the base to the socket. Once the base is fitted with the contacts, it is a simple task to assemble the lampholder. The bight of the clip itself closes the hole in the base.

According to the invention the floor has an inner face turned away from the socket and formed adjacent the hole with recessed seats holding the inner tabs so that the clip does not project past the floor inner face. In addition the inner tabs are punched out of the arms. They are elastically deformable and press the socket axially outward against the outer tabs. Thus the entire lampholder can be assembled without the use of tools, just snapped together.

In accordance with a further feature of this invention the socket and base have axially interfitting and complementary formations. The base is molded plastic, for instance polyphenyl sulfide or liquid crystal polymer, so that it can be molded to an exact shape. The socket is porcelain or ceramic.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
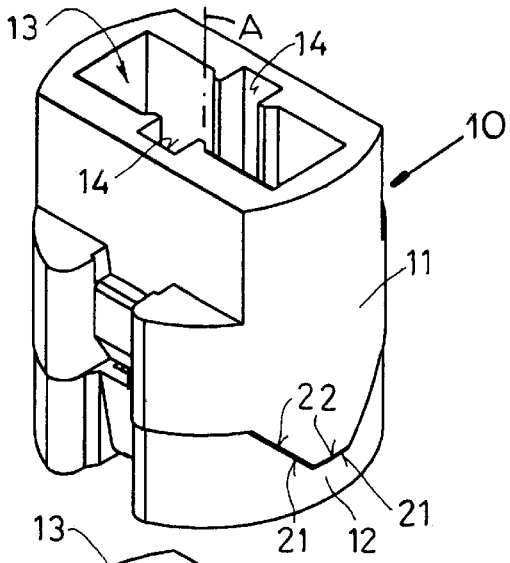
FIG. 1 is a perspective view of the lampholder according to the invention.
Figure 2:
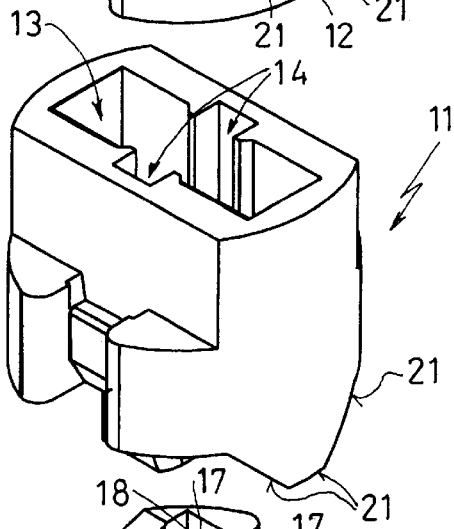
FIGS. 2, 3, and 4 are perspective views of the socket, base, and clip of the lampholder of this invention.
Figure 3:
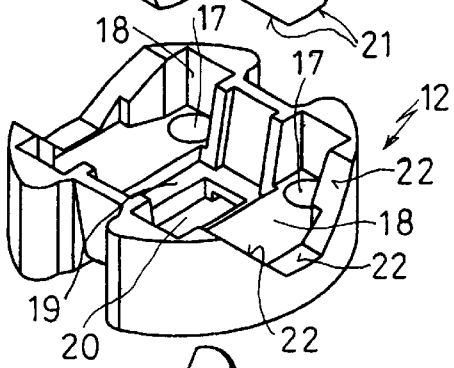
Figure 4:
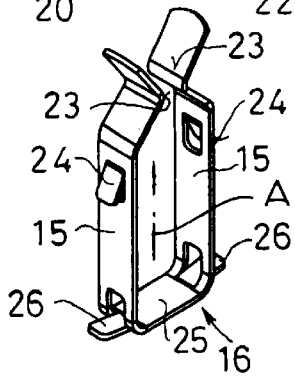

As seen in FIGS. 1 through 4 a lampholder 10 according to the invention basically comprises a socket 11 made of porcelain or ceramic, a base 12 molded of a plastic such as polyphenyl sulfide or liquid crystal polymer stable at high temperatures, and a clip 16 normally made of copper-clad sheet steel. These parts 10, 11, and 15 all are generally centered on and extend along an axis A.

Figure 5:
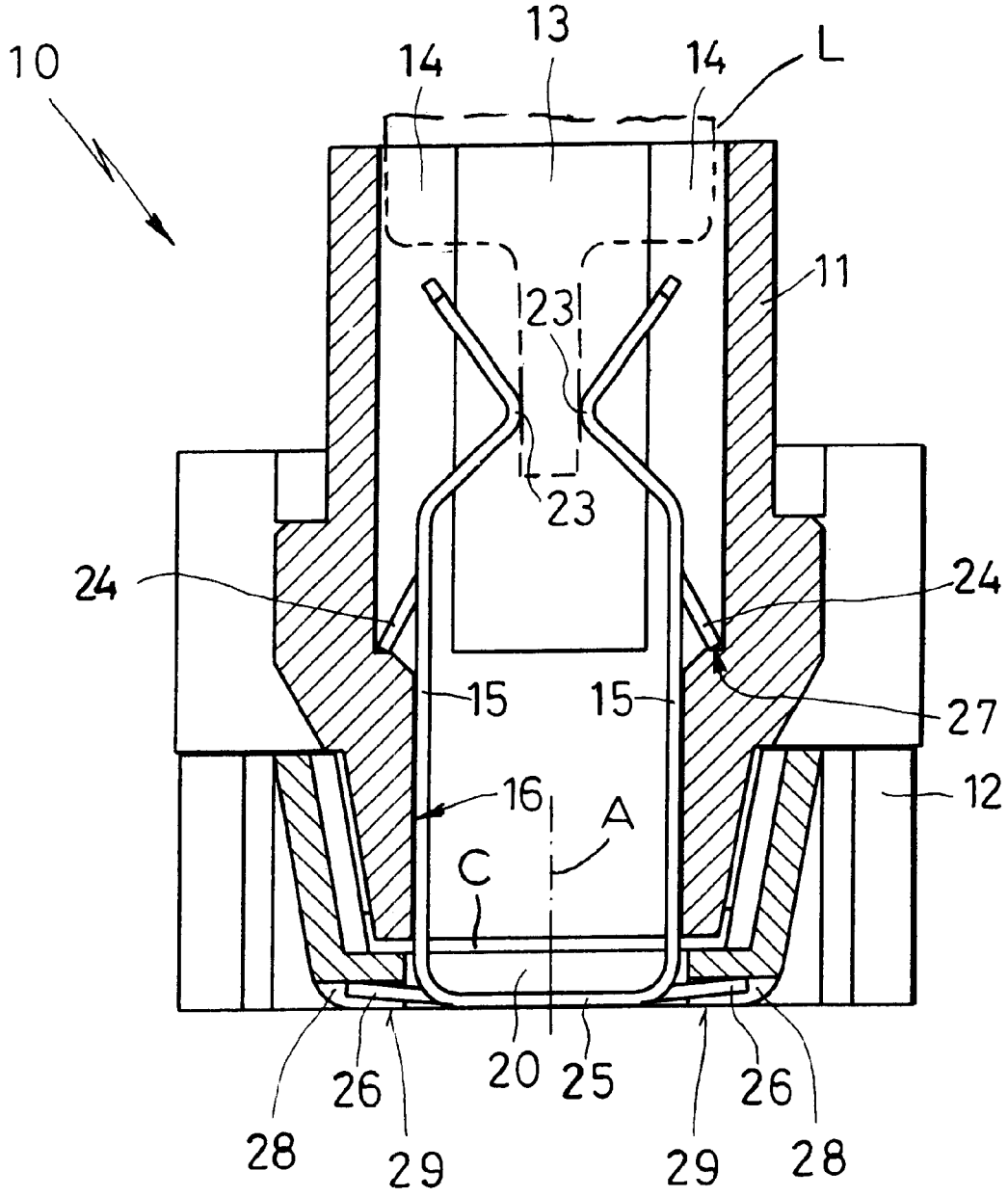
FIG. 5 is a large-scale axial section through the lampholder in accordance with the invention.
Figure 6:
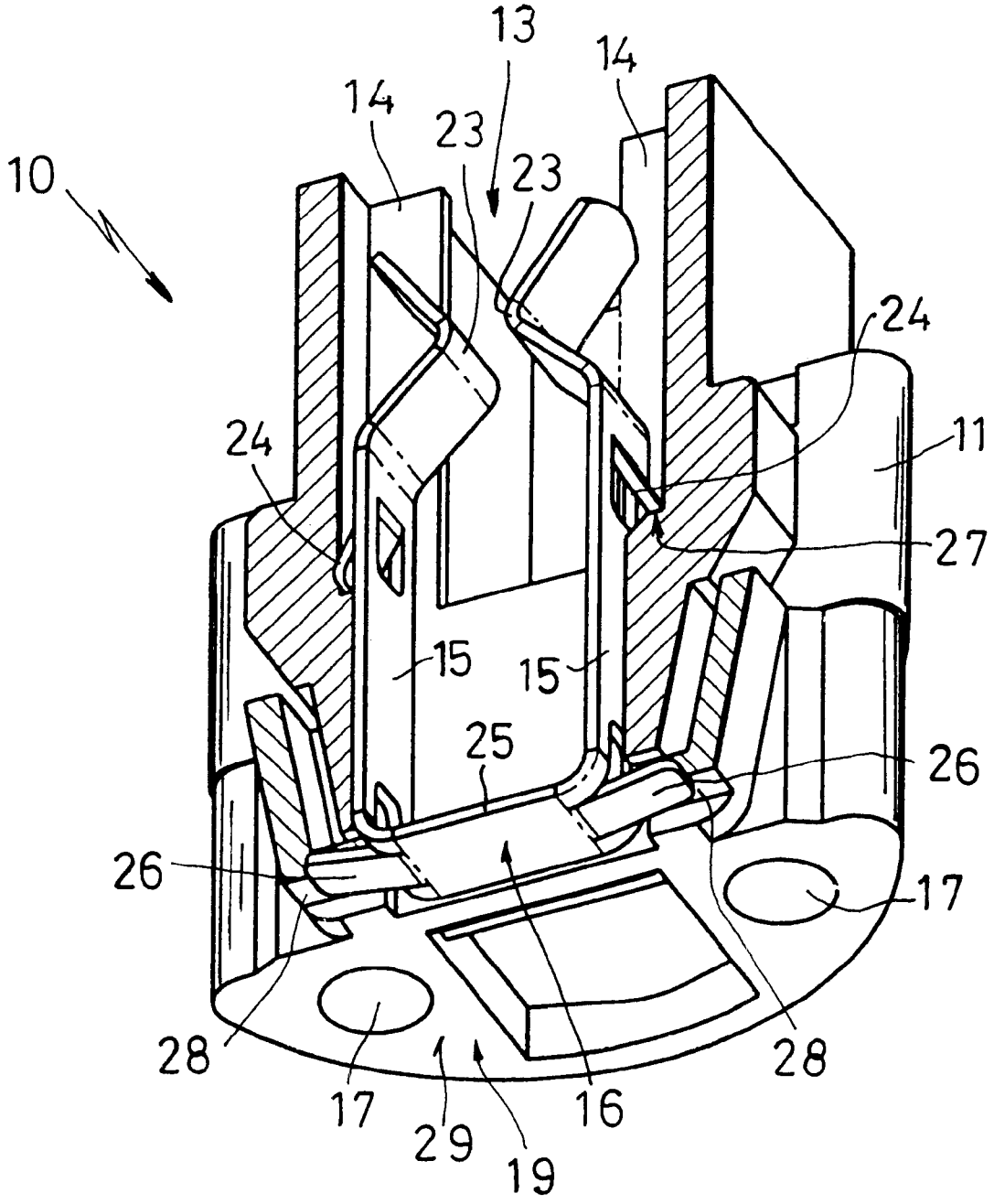
FIG. 6 is a large-scale sectional perspective view of the lampholder.

The socket 11 is formed with an axially throughgoing and stepped rectangular-section hole 13 having an outer end adapted here to fit with a standard G9 base of a lamp shown in dot-dash lines at L in FIG. 5 only. Opposite faces of hole 13 are formed with diametrally opposite and confronting rectangular-section grooves 14. A inner end of the socket 11 is formed with a pair of blunt axially inwardly projecting V-shaped projections or lug 21 that symmetrically flank the axis A.

The base 12 is essentially annular and formed with a pair of notches 22 complementary to and normally snugly receiving the lugs 21. A floor 19 of the base 12 has a central rectangular throughgoing hole or passage 20. A bottom face 29 of the base 12 lying in a plane perpendicular to the axis A is formed with a pair of diametrally oppositely extending grooves or seats 28 symmetrically flanking the hole 10. Throughgoing holes 17 are provided to allow unillustrated wires to pass through the floor 19 and join contacts C (FIG. 5 only) that sit in seats 18 flanking the hole 19 and that are of standard construction to connect with base pins on the lamp L fitted to the hole 13.

The clip 16 has a pair of axially extending parallel arms 15 interconnected by a transverse base 25. This base 25 is positioned in the hole 19 extending perpendicular to the axis A and the arms 15 extend outward in the grooves 14, with bent-in outer ends 23 of the arms 15 serving to grip the base of the lamp L in the hole 13. To hold the two parts 11 and 12 together, outer tabs 24 punched out of the arms 15 and extending away from each other and inward engage shoulders 27 formed in the grooves 14. In addition inner tabs 26 punched out of the arms 15 where they join the bight 25 are fitted to the seat grooves 28 and bear outward on the floor 19 of the base 12. The spacing between the outer faces of the inner tabs 26 and the inner ends of the outer tabs 24 is, in an unstressed condition of the clip 16, slightly less than the distance between the floors of the grooves 28 and the shoulders 27 so that the clip 16 is under slight axial tension to hold the two parts 11 and 12 tightly together. The planar bight part 25 of the clip 16 substantially fills and closes the hole 20 in the floor 19.

The lampholder 10 according to the invention is assembled by first, as is standard, fitting the contacts C to the seats 18 and connecting them, if necessary, to lead wires.

Then the socket 11 is fitted to the base 12 with the lugs 21 in the notches 22. The clip 16 is then pushed into the hole 19 from the bottom until the outer tabs 24 snap in place on the shoulders 27 and the inner tabs 26 come to bear on the floors of the seats 28. This completes the assembly. The lamp L can be pushed into the hole 13 so it is gripped between the arm ends 23 and its pins fit with the contacts C.

The lampholder 10 can be taken apart simply by prying inward the arms 15 of the clip to pull the outer tabs 24 off the shoulders 27. Then the clip 16 can be pulled axially inward out of the hole 20 to leave the lampholder 10 in three pieces.

We claim:

1. A lampholder comprising:

a socket having an inner end and forming an outwardly open hole defining an axis and adapted to fit with a base of a high-voltage lamp;

a base fittable against the inner end, formed with seats adapted to hold contacts, and having a floor formed with an axially throughgoing hole; and a clip formed with a bight engaged in the hole, a pair of arms extending from respective ends of the bight outward into the socket, outer tabs on the arms bearing axially inward on the socket, and inner tabs at the bight bearing axially outward on the floor of the base, whereby the clip holds the socket and base together.

2. The lampholder defined in claim 1 wherein the floor has an inner face turned away from the socket and formed adjacent the hole with recessed seats holding the inner tabs, whereby the clip does not project past the floor inner face.

3. The lampholder defined in claim 1 wherein the inner tabs are punched out of the arms.

4. The lampholder defined in claim 1 wherein the inner tabs are elastically deformable and press the socket axially outward against the outer tabs.

5. The lampholder defined in claim 1 wherein the socket and base have axially interfitting and complementary formations.

6. The lampholder defined in claim 1 wherein the base is molded plastic.

7. The lampholder defined in claim 6 wherein the plastic is polyphenyl sulfide or liquid crystal polymer.

8. The lampholder defined in claim 1 wherein the socket is porcelain or ceramic.

* * * * *